US005142878A

United States Patent [19]

Hida et al.

[11] Patent Number: 5,142,878

[45] Date of Patent: Sep. 1, 1992

[54] AUGER TYPE ICE MAKING MACHINE

[75] Inventors: Junichi Hida; Susumu Tatematsu; Naoya Uchida, all of Nagoya, Japan

[73] Assignee: Hoshizaki Denki Kabushiki Kaisha, Aichi, Japan

[21] Appl. No.: 643,959

[22] Filed: Jan. 22, 1991

[30] Foreign Application Priority Data

Jan. 23, 1990 [JP] Japan ..... 2-5283[U]

[51] Int. Cl.[5] ..... F25C 1/00

[52] U.S. Cl. ..... 62/137; 62/233; 62/158

[58] Field of Search ..... 62/233, 137, 138, 158; 222/64, 63, 564

[56] References Cited

U.S. PATENT DOCUMENTS 4,622,826 11/1986 Tsukiyama et al. ..... 62/137
4,803,847 2/1989 Koeneman et al. ..... 62/137 X
4,822,996 4/1989 Lind ..... 62/137 X

*Primary Examiner*—Albert J. Makay
*Assistant Examiner*—J. Sollecito
*Attorney, Agent, or Firm*—Nikaido, Marmelstein, Murray & Oram

[57] ABSTRACT

An auger type ice making machine having an evaporator housing vertically arranged above an ice storage bin, an auger mounted for rotary movement within the evaporator housing, an electric motor in drive connection with the auger, a compressor motor in drive connection with a compressor, an ice discharge duct provided on an upper end of the evaporator housing, an upstanding tubular delivery chute having an upper end connected to the discharge duct and a lower end in open communication into the storage bin, a movable detection plate provided within the upper end of the delivery chute to be moved by abutment with pieces of hard ice accumulated in the delivery chute, and an electric control apparatus for activating the motors when the detection plate is retained in an initial position and for deactivating the motors after lapse of a predetermined time when the detection plate has been moved from the initial position, the predetermined time being determined to be shorter than a time for which a space between the discharge duct and the detection plate is filled with the pieces of hard ice discharged from the duct after movement of the detection plate.

3 Claims, 5 Drawing Sheets

AUGER TYPE ICE MAKING MACHINE

BACKGROUND OF THE INVENTION

1. Field of the Invention

The present invention relates to an auger type ice making machine, more particulary to an auger type ice making machine of the type which is provided at its discharge opening with an upstanding ice delivery chute in connection to an ice storage bin.

2. Description of the Prior Art

In such an ice making machine as described above, electric motors for drive of an auger and a compressor are arranged to be deactivated with delay of a predetermined time when the ice storage bin has been filled with pieces of hard ice delivered from the delivery chute. If the pieces of hard ice are accumulated in the delivery chute and dissolved in a condition where the ice storage bin has not yet been filled with the pieces of hard ice, a movable detection plate for detection of stored ice in the bin will be frequently moved to open and close switch means of the electric motors in a short period of time, resulting in fatigue or damage of the compressor. Such a trouble as described above can be avoided by delay of the predetermined time. In the case that the delay of the predetermined time is too long, however, the delivery chute will be filled with the pieces of hard ice further discharged from the ice making machine after the stored ice in the storage bin has been detected by the movable detection plate. As a result, the movable detection plate will be retained in its displaced position by abutment with the pieces of hard ice packed in the upper end of the delivery chute. In such a condition, the ice making machine does not operate in spite of no presence of sufficient ice in the storage bin.

SUMMARY OF THE INVENTION

It is, therefore, a primary object of the present invention to provide an electric control apparatus for the ice making machine capable of overcoming the problem discussed above.

According to the present invention, there is provided an auger type ice making machine having a cylindrical evaporator housing vertically arranged above an ice storage bin and being surrounded by an evaporator coil in a refrigeration circuit, an auger mounted for rotary movement within the evaporator housing, an electric motor in drive connection with the auger, a compressor motor in drive connection with a compressor in the refrigeration circuit, an ice discharge duct provided on an upper end of the evaporator housing to discharge pieces of hard ice formed therein, an upstanding tubular delivery chute having an upper end connected to the discharge duct and a lower end in open communication into the interior of the ice storage bin, an ice detection mechanism including a movable detection plate provided within the upper end of the delivery chute to be moved by abutment with the pieces of hard ice accumulated in the delivery chute, and an electric control apparatus responsive to movement of the detection plate for activating the electric motor and the compressor motor when the detection plate is retained in an initial position and for deactivating the electric motor and the compressor motor when the detection plate has been moved from the initial position, wherein the electric control apparatus comprises control means for deactivating the electric motor and the compressor motor after lapse of a predetermined time when the detecting plate has been moved from the initial position, the predetermined time being determined to be shorter than a time for which a space between the discharge duct and the detection plate is filled with the pieces of hard ice discharged from the discharge duct after movement of the detection plate.

BRIEF DESCRIPTION OF THE DRAWINGS

Additional objects, features and advantages of the present invention will be more readily appreciated from the following detailed description of a preferred embodiment thereof when taken together with reference to the accompanying drawings, in which.

DESCRIPTION OF THE PREFERRED EMBODIMENT

Figure 1:
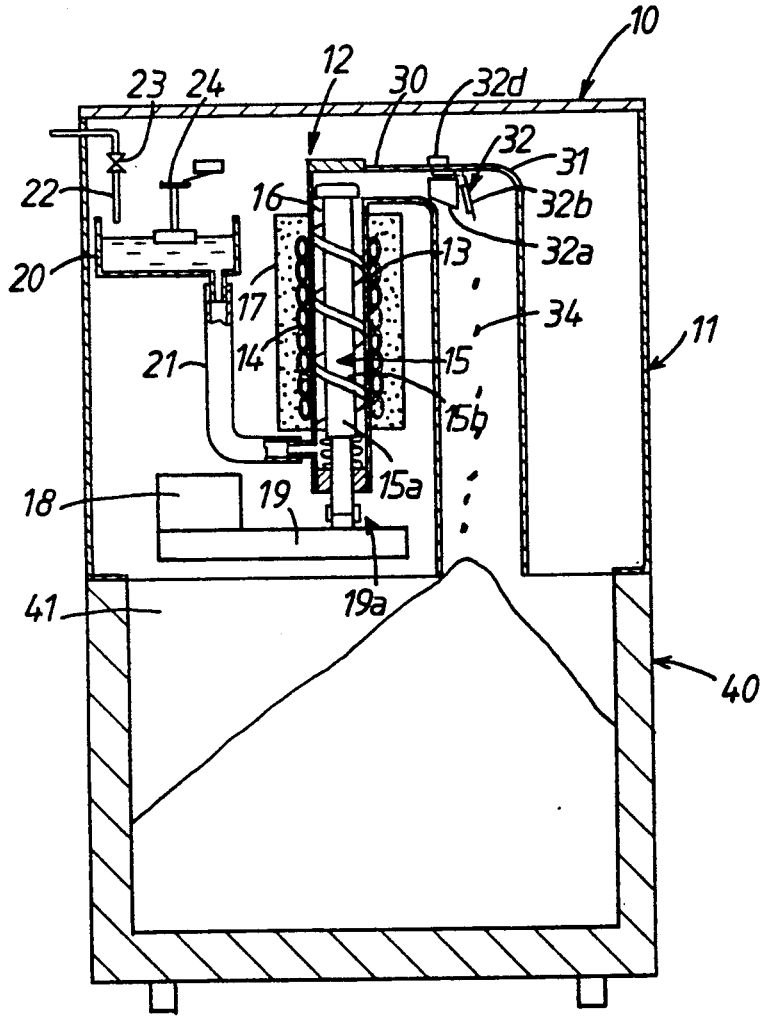
FIG. 1 is a vertical sectional view of an auger type ice making machine.
Figure 3:
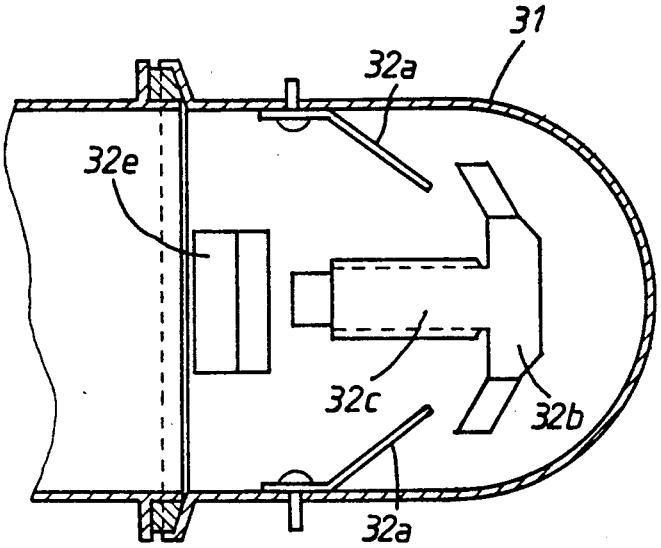
FIG. 3 is an enlarged sectional plan view showing a movable detection plate of the ice detection mechanism in relation to guide plates mounted within the delivery chute.

In FIG. 1 of the drawings, there is schematically illustrated an auger type ice making machine 10 composed of an ice making portion 11 and an ice storage portion 40. In the ice making portion 11, an ice making mechanism 12 includes an electric motor 18, a speed reduction mechanism 19 in drive connection with the electric motor 18, a cylindrical evaporator housing 13 vertically mounted on a casing of the speed reduction mechanism 19, an evaporator coil 14 wound around the evaporator housing 13 and covered with insulation material 17, an auger 15 mounted for rotary movement within the evaporator housing 13, and a breaker in the form of a cutter 16 mounted on the auger 15 for rotation therewith. The evaporator housing 13 is provided at its lower portion with an inlet port connected to a water tank 20 by means of a pipe 21 to be supplied with fresh water therefrom. The water tank 20 is arranged adjacent the upper portion of evaporator housing 13 to be supplied with fresh water from any suitable source of water (not shown) through a water supply pipe 22 provided with a solenoid water valve 23. The water tank 20 is provided therein with a float switch assembly 24 which includes, as shown in FIG. 4, upper and lower float swithes $FS_1$, $FS_2$ of the normally open type respectively for detecting upper and lower limit levels of water in the tank 20.

The evaporator coil 14 is provided as a part of a refrigeration circuit (not shown) to chill the evaporator housing 13 by evaporation of refrigerant passing therethrough thereby to form ice crystals on the internal freezing surface of the evaporator housing 13. The auger 15 has a shaft portion **15*a* rotatably mounted within the evaporator housing 13 and a helical blade 15*b* integrally formed on the shaft portion 15*a*. The shaft portion 15*a* of auger 15 is drivingly connected at its lower end to an output shaft 19*a* of speed reduction mechanism 19. In operation, the helical blade 15***b* of auger 15 scrapes the ice crystals off the internal freezing surface of evaporator housing 13 and advances the scraped ice crystals upwardly toward an extruding head (not shown) which forms a plenum at the top of auger 15. The scraped ice crystals are compressed at the extruding head and broken by the breaker 16 into pieces of hard ice to be discharged. The evaporator housing 13 is provided at its upper end with a discharge duct 30 which has a horizontal portion 31*a* for connection to the upper end of an upstanding tubular delivery chute 31. The vertical portion 31*b* of delivery chute 31 extends downwardly from the horizontal portion 31*a* of discharge duct 30 to discharge the pieces of hard ice therethrough into the interior of ice storage bin 41.

An ice detection mechanism 32 is provided within the upper end of upstanding tubular delivery chute 31 to detect accumulation of the pieces of hard ice in the vertical portion 31*b* of delivery chute 31. The ice detection mechanism 32 includes a movable detection plate 32*b* rotatably mounted to an internal surface of the upper end wall of delivery chute 31 and a proximity switch 32*d* mounted on an external surface of the upper end wall of delivery chute 31. The detection plate 32*b* has a horizontal contact portion 32*c* which is in contact with the internal surface of the upper end wall of delivery chute 31 to normally close the proximity switch 32*d*. When the detection plate 32*b* is pushed upwardly in a direction shown by an arrow in the figure by engagement with the pieces of hard ice accumulated in the vertical portion 31*b* of delivery chute 31, the horizontal contact portion 32*c* of detection plate 32*b* is separated from the upper end wall of delivery chute 31 to open the proximity switch 32*d*. In a practical embodiment of the present invention, the proximity switch 32*d* may be replaced with a mechanical switch, a photo-electric switch or the like. In the ice detection mechanism 32, a pair of opposed guide plates 32*a* are secured to the upper side walls of delivery chute 31 and located at an inside of the detection plate 32*b* to direct the pieces of hard ice discharged from duct 30 to the detection plate 32*b*. A baffle plate 32*e* is secured to the internal surface of the upper end wall of delivery chute 31 to protect the horizontal contact portion 32*c* of detection plate 32*b* from the pieces of hard ice discharged from duct 30.

Figure 4:
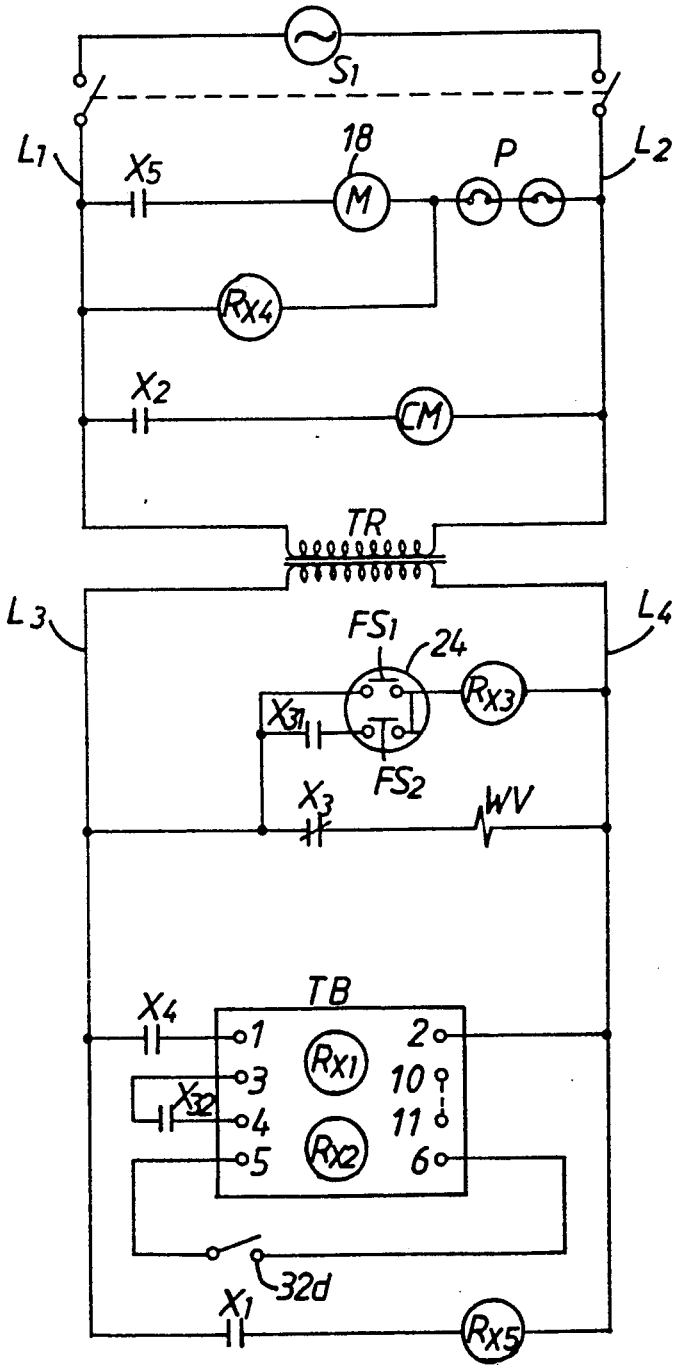
FIG. 4 is a circuit diagram of an electric control apparatus for the ice making machine shown in FIG. 1.

As shown in FIG. 4, an electric control apparatus for the ice making machine includes a main switch $S_1$ connected to an electric power source through common power source lines $L_1$, $L_2$ to be closed for operation of the ice making machine, The electric motor 18 is connected at its one end with the common power source line $L_1$ through a normally open relay switch $X_5$ and at its other end with the common power source line $L_2$ through a protector P for protecting the electric motor 18 from overheating. When the relay switch $X_5$ is closed, the electric motor 18 is activated by the electric power applied thereto from the power source to rotate the auger 15. A compressor motor CM is connected at its one end with the common power source line $L_1$ through a normally open relay switch $X_2$ and at its other end with the common power source line $L_2$. When the relay switch $X_2$ is closed, the compressor motor CM is activated by the electric power applied thereto from the power source to compress gaseous refrigerant in the refrigeration circuit. Common power source lines $L_3$, $L_4$ are connected to the common power source lines $L_1$, $L_2$ through a transformer TR to be supplied with the electric power at a predetermined voltage.

Figure 5:
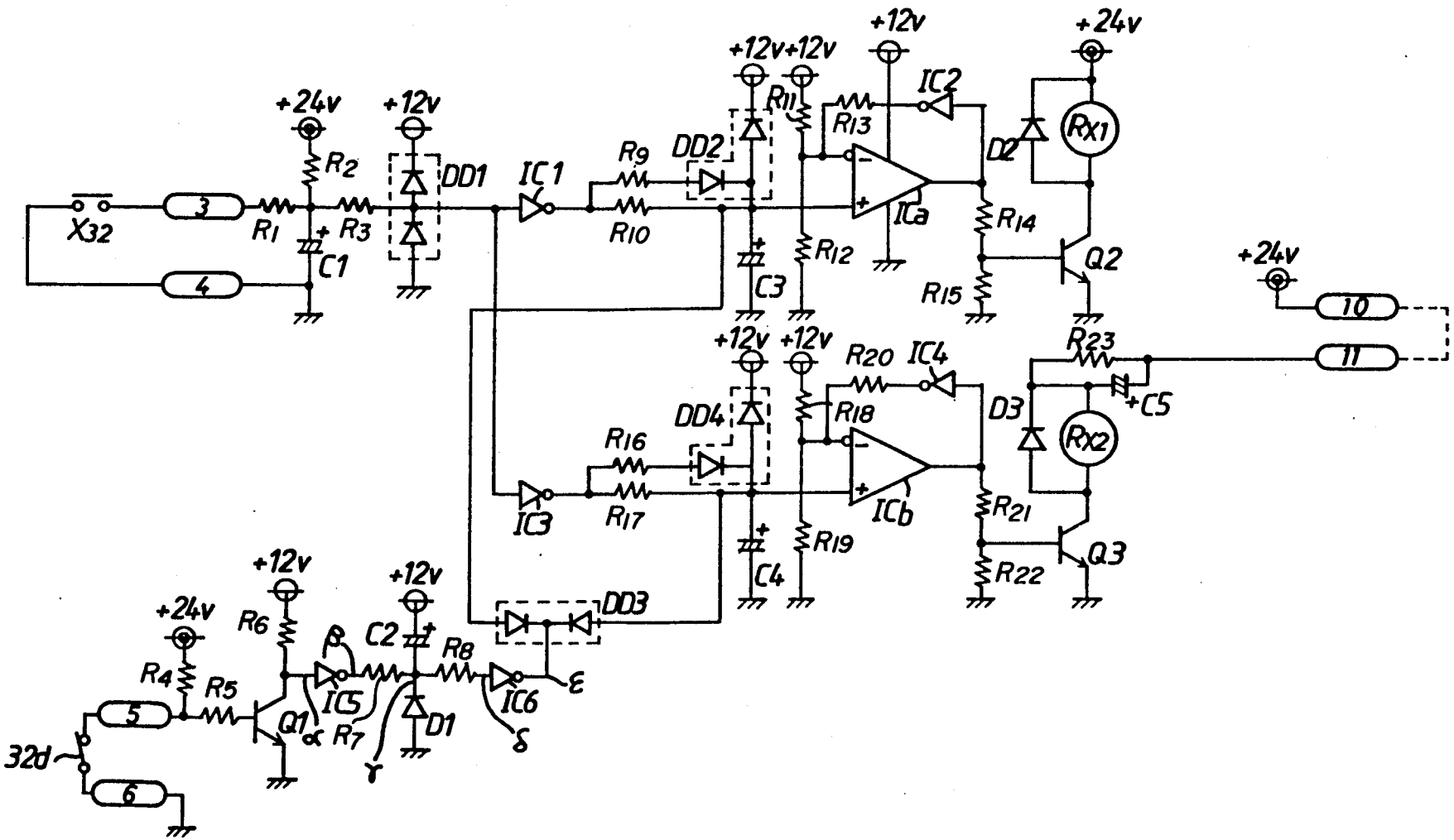
FIG. 5 is a diagram of an electric control circuit for drive of relay coils shown in FIG. 4.

The upper float switch $FS_1$ of the normally open type is connected at its one end with the common power source line $L_3$ and at its other end with the common power source line $L_4$ through a relay coil $R_{X3}$ to be closed when the water level rises up to the upper limit level, while the lower float switch $FS_2$ of the normally open type is connected at its one end with the common power source line $L_3$ through a normally open relay switch $X_{31}$ and at its other end with the common power source line $L_4$ through the relay coil $R_{X3}$ to be closed when the water level falls to the lower limit level. The solenoid of water valve WV is connected at its one end with the common power source line $L_3$ through a normally closed relay switch $X_3$ and at its other end with the common power source line $L_4$ to be energized when applied with the predetermined voltage under control of the relay switch $X_3$. A relay coil $R_{X1}$ is associated with a normally open relay switch $X_1$ to provide a relay for control of the electric motor 18. As shown in FIG. 5, the relay coil $R_{X1}$ is connected at its one end with a power source of +24 volt and at its other end with the collector of a transistor Q2 to be energized or deenergized under control of a normally open relay switch $X_{32}$ and the proximity switch 32*d*. A relay coil $R_{X2}$ is associated with a normally open relay switch $X_2$ to provide a relay for control of the compressor motor CM. As shown in FIG. 5, the relay coil $R_{X2}$ is connected at its one end with a condenser C5 and an N terminal of a diode D3 and at its other end with the collector of a transistor Q3 to be energized or deenergized under control of the normally open relay switch $X_{32}$ and the proximity switch 32*d*.

The relay coil $R_{X3}$ is associated with the normally open relay switches $X_{31}$, $X_{32}$ and the normally closed relay switch $X_3$ to provide a relay for control of the solenoid water valve WV. The relay coil $R_{X3}$ is energized when the float switches $FS_1$, $FS_2$ are closed. A relay coil $R_{X4}$ is associated with a normally open relay switch $X_4$ to provide a relay for control of an electric control circuit shown in FIG. 5. The relay coil $R_{X4}$ is connected at its one end with the common power source line $L_1$ and at its other end with the common power source line $L_2$ through the motor protector P to be energized by the electric power applied thereto from the power source. A relay coil $R_{X5}$ is associated with the normally open relay switch $X_5$ to provide a relay for control of the electric motor 18. The relay coil $R_{X5}$ is connected at its one end with the normally open relay switch $X_1$ and at its other end with the common power source line $L_4$ to be energized or deenergized under control of the relay switch $X_1$.

A circuit board TB shown in FIG. 4 is provided thereon with the electric control circuit shown in FIG. 5. The circuit board TB has a first terminal 1 connected with the common power source line $L_3$ through the normally open relay switch $X_4$, a second terminal 2 connected with the power source line $L_4$, a third terminal 3 connected with a fourth terminal 4 through the normally open relay switch $X_{32}$, and a fifth terminal 5 connected with a sixth terminal 6 through the proximity switch 32*d*. As shown in FIG. 5, the electric control circuit on the circuit board TB includes the relay coils $R_{X1}$, $R_{X2}$, resistors $R_1$–$R_{23}$, condensers C1–C5, transistors Q1–Q3, diodes D1–D3, double diodes DD1–DD4, inverters IC1–IC6, and OP amplifiers ICa–ICb. As described above, the electric circuit is designed to energize or deenergize the relay coils $R_{X1}$, $R_{X2}$ under control of the normaly open relay switch $X_{32}$ and proximity switch 32*d*. The electric circuit is divided into a first portion from the terminals 3, 4 to the double diode DD1, a second portion from the terminals 5, 6 to the double diode DD3, a third portion from the inverter IC1 to the transistor Q2, and a fourth portion from the inverter IC3 to the transistor Q3.

The first circuit portion is designed to apply the input voltage to the inverters IC1, IC3 under control of the normally open relay switch $X_{32}$. The second circuit portion is designed to discharge the condensers C3, C4 under control of the proximity switch 32*d*. The condenser C2 is associated with the resistor $R_7$ to delay discharge of the condensers C3, C4 when the proximity switch 32*d* has been opened. Thus, a time $T_3$ for delaying deenergization of the relay coils $R_{X1}$, $R_{X2}$ is determined by the time constant of condenser C2 and resistor $R_7$. The third and fourth circuit portions are designed to energize or deenergize the relay coils $R_{X1}$, $R_{X2}$ in accordance with a condition of the input side. The condensers C3, C4 are charged by the voltage applied thereto through the inverters IC1, IC3. The resistors $R_9$, $R_{16}$ are associated with the condensors C3, C4 respectively to define a time constant for charge of the condensers C3, C4. When the normally open relay switch $X_{32}$ is opened, the condensers C3, C4 are discharged. The resisters $R_{10}$, $R_{17}$ are associated with the condensers C3, C4 to define a time constant for discharge of the condensers C3, C4. When the condensers C3, C4 are charged, the voltage at each plus terminal of OP amplifiers ICa, ICb becomes higher than that at each minus terminal of the same. Under such a condition, the OP amplifiers ICa, ICb each produce a high level signal therefrom. When the voltage at each plus terminal of OP amplifiers ICa, ICb becomes lower than that at each minus terminal of the same due to discharge of the condensers C3, C4, the OP amplifiers ICa, ICb each produces a low level signal therefrom. When applied with the high level signals from OP amplifiers ICa, ICb, the transistors Q2, Q3 are turned on to energize the relay coils $R_{X1}$, $R_{X2}$. When applied with the low level signals from OP amplifiers ICa, ICb, the transistors Q2, Q3 are turned off to deenergize the relay coils $R_{X1}$, $R_{X2}$.

Assuming that the main switch $S_1$ is closed, the relay coil $R_{X4}$ is energized to close the normally open relay switch $X_4$ for activation of the electric control circuit on the circuit board TB. Simultaneously, the solenoid of water valve WV is energized by the electric power applied through the normally closed relay switch $X_3$ to permit the supply of fresh water into the tank 20 from the source of water. When the level of water in tank 20 rises up to the upper limit level, the upper float switch $FS_1$ is closed to energize the relay coil $R_{X3}$. In response to energization of the relay coil $R_{X3}$, the normally open relay switches $X_{31}$, $X_{32}$ are closed while the normally closed relay switch $X_3$ is opened. In this instance, the relay coil $R_{X3}$ is supplied with the electric power through the relay switch $X_{31}$ and lower float switch $FS_2$ to be maintained in its energized condition. When the normally open relay switch $X_{32}$ is closed, the relay coil $R_{X1}$ is energized after lapse of a first predetermined time $T_1$ (for instance, 1 sec), and the relay coil $R_{X2}$ is energized after lapse of a second predetermined time $T_2$ (for instance, 60 sec) as will be described hereinafter with reference to FIG. 5.

Assuming that the proximity switch 32*d* is maintained in its closed position in a condition where an amount of hard ice pieces stored in the storage bin 41 is still insufficient and that the normally open relay switch $X_{32}$ is maintained in its open position, the output voltage of inverter IC1 is maintained at a low level. In such a condition, the condenser C3 may not be charged, and the voltage at the minus terminal of OP amplifier ICa is maintained to be higher than that at the plus terminal of the same. Thus, the output of OP amplifier ICa is maintained at a low level so that the transistor Q2 is turned off to maintain the relay coil $R_{X1}$ in its deenergized condition. Similarly, the transistor Q3 is turned off to maintain the relay coil $R_{X2}$ in its deenergized condition. When the normally open relay switch $X_{32}$ is closed by rise of the water level in tank 20, the output voltage of inverter IC1 becomes a high level to start charge of the condenser C3. In this instance, the output of OP amplifier ICa is still maintained at a low level, and the output of inverter IC2 is maintained at a high level. Thus, the voltage at the plus terminal of OP amplifier ICa is maintained to be $\frac{2}{3}$ Vcc of the source voltage defined by resistors $R_{11}$, $R_{12}$. When the condenser C3 is charged up to a voltage corresponding with $\frac{2}{3}$ Vcc of the source voltage, the output of OP amplifier ICa becomes a high level. This causes the voltage at the minus terminal of OP amplifier ICa to be $\frac{1}{3}$ Vcc of the source voltage under control of the inverter IC2. As a result, the transistor Q2 is turned on to energize the relay coil $R_{X1}$. The time for which the output of OP amplifier ICa is changed to the high level from the low level is determined mainly in dependence upon the time constant of resistor $R_9$ and condenser C3. Similarly, the time for which the output of OP amplifier ICb is changed to the high level from the low level is determined mainly in dependence upon the time constant of resistor $R_{16}$ and condenser C4.

Figure 6:
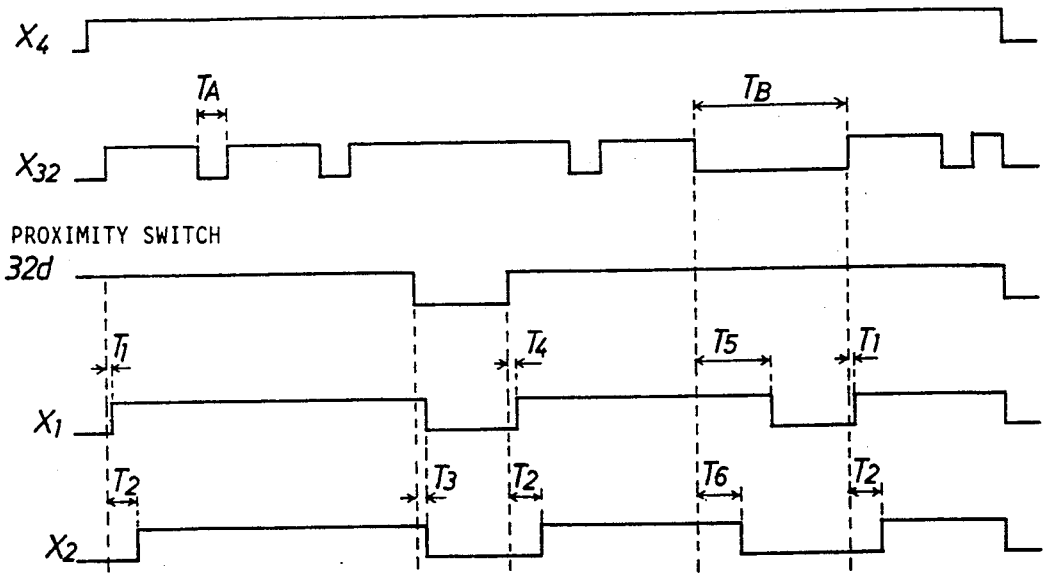
FIG. 6 is a graph illustrative of operation of relay switches shown in FIG. 4.

When the lower float switch $FS_2$ is opened by fall of the water level in tank 20, the normally closed relay switch $X_3$ is closed, and the normally open relay switch $X_{32}$ is opened to cause discharge of the condensers C3, C4. As the time constant for discharge of the condensers C3, C4 is determined to be a predetermined time suitable for operation of the ice making machine, the tank 20 is supplied with fresh water until the condensers C3, C4 are fully discharged. When the upper float switch $FS_1$ is closed by rise of the water level in tank 20, the normally closed relay switch $X_3$ is opened, and the normally open relay switch $X_{32}$ is closed. (see $T_A$ in FIG. 6) Thus, the condensers C3, C4 are charged again, and the output of OP amplifiers ICa, ICb is maintained at a high level to maintain the relay coils $R_{X1}$, $R_{X2}$ at their energized conditions until the condensers C3, C4 are fully charged. When the condensers C3, C4 have been fully charged, the relay coils $R_{X1}$, $R_{X2}$ are deenergized with delay of times $T_5$, $T_6$. (see $T_B$ in FIG. 6) Such control of the relay coils $R_{X1}$, $R_{X2}$ is useful to deactivate the electric motor 18 and the compressor motor CM when the supply of fresh water into tank 20 has been cut off for a long time.

When the relay coil $R_{X1}$ is energized, the normally open relay switch $X_1$ is closed to energize the relay coil $R_{X5}$ thereby to close the normally open relay switch $X_5$ for activating the electric motor 18. When the relay coil $R_{X2}$ is energized, the normally open relay switch $X_2$ is closed to activate the compressor motor CM. Thus, the evaporator housing 13 is chilled by evaporation of the refrigerant circulated through the evaportor coil 14 under operation of the compressor motor CM to form ice crystals therein, and the auger 15 is rotated by the electric motor 18 to scrap the ice crystals off the internal freezing surface of evaporator housing 13 and advance the scraped ice crystals upwardly toward the extruding head. The ice crystals compressed at the extruding head is broken by the breaker 16 into pieces of hard ice. In turn, the pieces of hard ice are discharged from the discharge duct 30 and delivered into the ice storage bin 41 through the upstanding delivery chute 31. During such operation of the ice making machine, the pieces of hard ice are stored in the storage bin 41 and accumulated in the upstanding delivery chute 31. When the pieces of hard ice are further discharged into the delivery chute 31, the movable detection plate **32*b* is pushed upwardly by abutment with the pieces of hard ice so that the horizontal contact portion 32*c* of detection plate 32*b* is separated from the upper end wall of delivery chute 31 to open the proximity switch 32*d*. In this instance, the pieces of hard ice from the discharge duct 30 are guided by the guide plates 32*a* and baffle plate 32*c* to direct toward the detection plate 32*b*. When the proximity switch 32*d* is opened, the condensers C3, C4** are discharged after lapse of a predetermined time $T_3$ (for instance, 6.4 sec) to deenergize the relay coils $R_{X1}$, $R_{X2}$.

Figure 2:
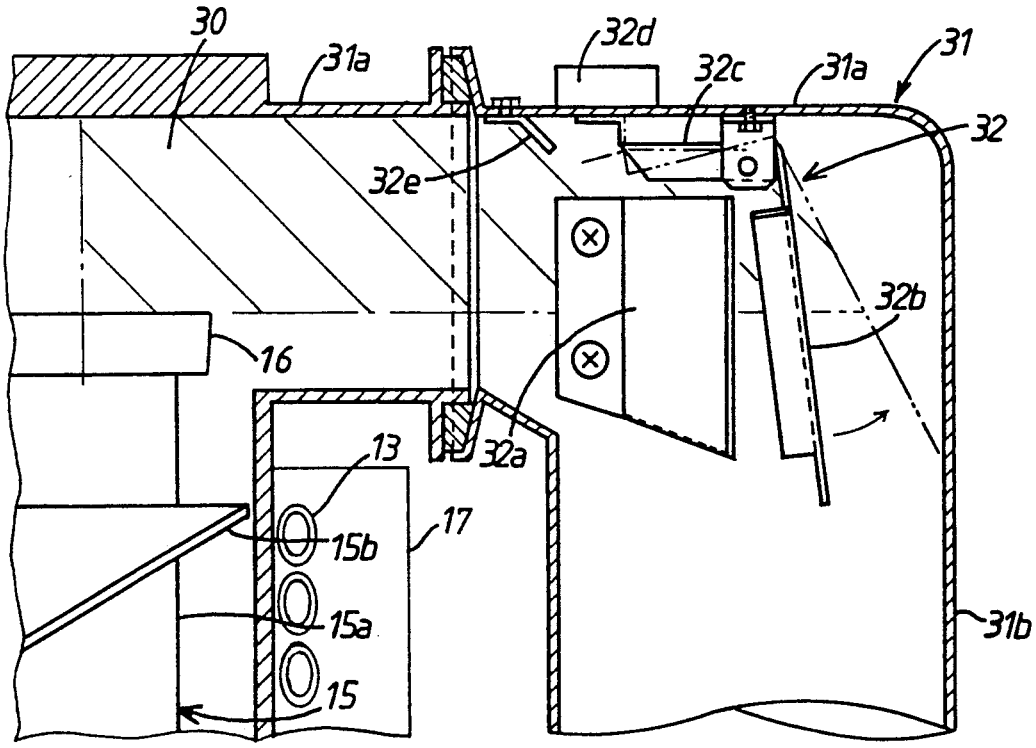
FIG. 2 is an enlarged vertical sectional view showing an ice detection mechanism provided within an ice delivery chute of the ice making machine.

In this embodiment, the predetermined time $T_3$ is determined in a manner as described hereinafter. Assuming that the proximity switch **32*d* has been opened in a condition where the condenser C2 is fully charged, the transistor Q1 is turned on to cause a ground level at point $\alpha$ and +12 v at point $\beta$. In this instance, the ground level appears at points $\gamma$ and $\delta$, and +12 v appears at point $\epsilon$. The electric potential at point $\gamma$ rises in accordance with discharge of the condenser C2. When the electric potential at point $\delta$ exceeds a threshold level of inverter IC6, the electric potential at point $\epsilon$ becomes the ground level, and in turn, the condensers C3, C4 are discharged through double diode DD3. When the electric potential of condensers C3, C4 falls below $\frac{1}{3}$ Vcc at each plus terminal of OP amplifiers ICa, ICb, the output of OP amplifiers ICa, ICb becomes a low level to deenergize the relay coils $R_{X1}$, $R_{X2}$. From the above description, it will be understood that the predetermined time $T_3$ is determined by the time constant of condenser C2 and resistor $R_7$. In this embodiment, it is to be noted that the predetermined time $T_3$ is determined to be shorter than a time for which the space between the discharge duct 30 and the detection plate 32*b* shown by oblique lines in FIG. 2 is fully filled with the pieces of hard ice discharged from the discharge duct 30. The capacity of the space between the discharge duct 30 and the detection plate 32*b*** is determined taking into consideration the shape and size of hard ice pieces. In the case that the weight of ice flakes stored in the space is M (g), the space capacity is determined to be M/0.35 ($cm^3$).

When the normally open relay switch $X_1$ is opened by deenergizaion of the relay coil $R_{X1}$, the relay coil $R_{X5}$ is deenergized to open the relay switch $X_5$ thereby to deactivate the electric motor 18. When the normally open relay switch $X_2$ is opened by deenergization of the relay coil $R_{X2}$, the compressor motor CM is deactivated to render the ice making machine inoperative. When the stored hard ice pieces in the storage bin 41 is consumed, the detection plate **32*b* is returned to its initial position to close the proximity switch 32*d*. As a result, the relay coil $R_{X1}$ is energized after lapse of a predetermined time $T_4$ (for instance, 6.4 sec) to activate the electric motor 18, and the relay coil $R_{X2}$ is energized after lapse of a predetermined time $T_2$ (for instance, 60 sec) to activate the compressor motor CM. In this instance, the electric motor 18 is activated prior to activation of the compressor motor CM to smoothly rotate the auger 15**.

As will be understood from the above description, the electric control circuit of FIG. 5 is characterized in that the time constant of condenser C2 and resistor $R_7$ is determined in such a manner that the predetermined time $T_3$ is determined to be shorter than the time for which the space between the discharge duct 30 and the detection plate **32*b* is filled with the pieces of hard ice discharged from the ice making machine. Under control of the electric control circuit, the electric motor 18 and compressor motor CM are deactivated with delay of the predetermined time $T_3$ when the proximity switch 32*d* has been opened by movement of the detection plate 32*b*. This is effective to eliminate trouble caused by accumulation of the hard ice pieces in the upstanding delivery chute 31**.

Having now fully set forth a preferred embodiment of the concept underlying the present invention, various other embodiments as well as certain variations and modifications of the embodiment shown and described herein will obviously occur to those skilled in the art upon becoming familiar with said underlying concept. It is to be understood, therefore, that within the scope of the appended claims, the invention may be practiced otherwise than as specifically set forth herein.

What is claimed is:

1. An auger type ice making machine having a cylindrical evaporator housing vertically arranged above an ice storage bin and being surrounded by an evaporator coil in a refrigeration circuit, an auger mounted for rotary movement within said evaporator housing, an auger motor in drive connection to said auger, a compressor motor in drive connection to a compressor in said refrigeration circuit, an ice discharge duct horizontally provided on an upper end of said evaporator housing to discharge pieces of hard ice therefrom, an upstanding tubular delivery chute having an upper end connected to said discharge duct and a lower end in open communication into said ice storage bin, an ice detection mechanism including a movable detection plate provided within the upper end of said delivery chute to be moved by abutment with the pieces of hard ice accumulated in said delivery chute, and an electric control apparatus responsive to movement of said detection plate for activating said auger motor and said compressor motor when said detection plate is retained in an initial position and for deactivating said auger motor and said compressor motor with a predetermined time delay when said detection plate has been moved from the initial position, wherein said electric control apparatus comprises control means for determining the predetermined time to be shorter than a time for which said discharge duct between the upper end of said evaporator housing and said detection plate is filled with the pieces of hard ice discharged from said auger after movement of said detection plate.

2. An auger type ice making machine as claimed in Claim 1, wherein said ice detection mechanism includes switch means arranged to be opened or closed in response to movement of said detection plate, and wherein said control means comprises a time constant circuit for determining the predetermined time to be shorter than a time for which said discharge duct between the upper end of said evaporator housing and said detection plate is filled with the pieces of hard ice discharged from said auger after movement of said detection plate.

3. An auger type ice making machine as claimed in Claim 1, wherein said control means is arranged to determine the predetermined time for delay of deactivation of said motors taking into consideration with the capacity of said discharge duct between the upper end of said evaporator housing and said detection plate and the size of the hard ice pieces.

* * * * *